US006837675B2

(12) United States Patent
Usui et al.

(10) Patent No.: US 6,837,675 B2
(45) Date of Patent: Jan. 4, 2005

(54) FUEL PUMP

(75) Inventors: Takayuki Usui, Obu (JP); Kenzo Nagasaka, Obu (JP); Koichi Iwata, Obu (JP)

(73) Assignee: Aisan Kogyo Kabushiki Kaisha, Aichi (JP)

( * ) Notice: Subject to any disclaimer, the term of this patent is extended or adjusted under 35 U.S.C. 154(b) by 0 days.

(21) Appl. No.: 10/327,789

(22) Filed: Dec. 23, 2002

(65) Prior Publication Data

US 2003/0118439 A1 Jun. 26, 2003

(30) Foreign Application Priority Data

Dec. 26, 2001 (JP) ..... 2001-394754

(51) Int. Cl.[7] ..... F04D 5/00
(52) U.S. Cl. ..... 415/55.1
(58) Field of Search ..... 415/55.1, 55.2, 415/55.3, 55.4, 55.5, 55.6, 55.7, 224, 232; 417/423.3

(56) References Cited

U.S. PATENT DOCUMENTS 4,445,821 A * 5/1984 Watanabe et al. ..... 415/55.1
4,591,311 A * 5/1986 Matsuda et al. ..... 415/55.5
4,619,591 A * 10/1986 Iwai et al. ..... 417/422
4,948,344 A * 8/1990 Cygnor ..... 415/55.1
5,257,916 A * 11/1993 Tuckey ..... 415/55.2
6,499,941 B1 * 12/2002 Fischer ..... 415/55.1

FOREIGN PATENT DOCUMENTS

DE 4221184 A1 1/1994
DE 19634734 A1 3/1998
JP 7279881 10/1995

OTHER PUBLICATIONS

English translation as provided by Japan Patent Office via computer (claims and specification).

* cited by examiner

*Primary Examiner*—Edward K. Look
*Assistant Examiner*—Richard A. Edgar
(74) *Attorney, Agent, or Firm*—Baker Botts LLP

(57) ABSTRACT

A fuel pump capable of using the pump efficiency most efficiently without reducing the useful service life is provided. A relatively large clearance allowing for the expected amount of wear is ensured in a region where the flow passage groove pressure is low. In a region where the flow passage groove pressure is high, it is unnecessary to allow for the wear. Therefore, the clearance is set relatively small.

3 Claims, 9 Drawing Sheets

FUEL PUMP

BACKGROUND OF THE INVENTION

1. Field of the Invention

The present invention relates to a fuel pump adapted to suck in and pressurize a fuel such as gasoline and discharge the pressurized fuel.

2. Discussion of Related Art

A fuel pump has an impeller and a pump casing, as disclosed in Japanese Patent Application Unexamined Publication (KOKAI) No. Hei 7-279881. The impeller has an approximately disk-shaped configuration with a plurality of blade grooves formed serially in a region extending along the outer peripheries of the obverse and reverse sides of the disk-shaped impeller. The impeller is rotated by a driving device such as a motor. The pump casing surrounds the impeller and has a circumferentially extending recess for forming a circumferentially extending flow passage groove between the same and the blade grooves of the impeller. The pump casing further has a suction opening communicating with the upstream end of the recess and a discharge opening communicating with the downstream end of the recess. Further, the pump casing has a circumferential wall forming an inner peripheral surface extending along the outer peripheral surface of the impeller. When the impeller rotates, fuel is sucked into the flow passage groove from the suction opening and pressurized while flowing circumferentially in the flow passage groove. The pressurized fuel is discharged from the discharge opening.

In this case, the size of the clearance between the impeller outer peripheral surface and the pump casing inner peripheral surface has a significant effect on the pump efficiency. The smaller the clearance, the smaller the amount of fuel leakage, and the higher the pump efficiency.

However, the fuel pump is usually used for a long period of time. During use, the bearings supporting the shaft for rotating the impeller unavoidably wear out, causing the center of rotation of the impeller to be displaced gradually by small amounts. For this reason, if the above-described clearance is set excessively small, the impeller outer peripheral surface and the pump casing inner peripheral surface may contact each other when the rotation center of the impeller is displaced, resulting in a failure of the pump operation.

Therefore, the conventional practice is to allow some margin for the clearance between the impeller outer peripheral surface and the pump casing inner peripheral surface so that these peripheral surfaces will not contact each other even if the rotation center of the impeller is displaced as a result of wear of the bearings.

SUMMARY OF THE INVENTION

Consequently, the conventional fuel pump has a pump efficiency lower than that exhibited when the fuel pump is designed without considering the wear of the bearings. The reason for this is as follows. If the wear is taken into consideration, it becomes necessary to allow some margin for the clearance between the impeller outer peripheral surface and the pump casing inner peripheral surface, and if a margin is allowed for the clearance, the pump efficiency reduces unfavorably.

Under these circumstances, it has been demanded to improve the pump efficiency while ensuring a clearance sufficient to prevent the impeller outer peripheral surface and the pump casing inner peripheral surface from contacting each other even if the rotation center of the impeller is displaced as a result of wear of the bearings.

The present inventors examined in detail the phenomenon that the rotation center of the impeller is displaced as a result of wear of the bearings, and as a result, found that the wear progresses intensively in a specific direction. The reason for this may be understood as follows. The fuel is pressurized while flowing circumferentially along the flow passage groove, as stated above. The pressure in the circumferentially extending flow passage groove is not uniform. The pressure is low in a portion adjacent to the suction opening and high in a portion adjacent to the discharge opening. Accordingly, the impeller outer peripheral surface is subjected to a non-uniform pressure. That is, a relatively low pressure acts on the impeller outer peripheral surface at the portion adjacent to the suction opening, and a relatively high pressure acts on the impeller outer peripheral surface at the portion adjacent to the discharge opening. The non-uniform pressure distribution causes a force to act on the impeller in the direction from a region where the flow passage groove pressure is high toward a region where the flow passage groove pressure is low. The bearings keep the rotation center of the impeller against the force acting on the impeller as stated above. If the fuel pump continues to be used under the above-described conditions, the bearings supporting the rotating shaft of the impeller wear out intensively in the region where the flow passage groove pressure is low.

The conventional fuel pump does not make use of the knowledge that the wear progresses intensively in a specific direction. Even if the rotation center of the impeller has been displaced as a result of wear of the bearings, the clearance sufficient to avoid contact between the impeller outer peripheral surface and the pump casing inner peripheral surface is ensured in all directions.

The studies conducted by the present inventors have revealed that the wear progresses intensively in a specific direction, and hence proved that it is necessary to allow for the expected amount of wear only in the direction of progress of wear to ensure the required clearance, and it is unnecessary to allow for the wear in a direction in which wear will not progress. It has been found that the clearance can be reduced in the direction in which no wear will progress, and a reduction in the clearance causes an improvement in the pump efficiency.

A first structure of the fuel pump created by the present invention has an impeller and a pump casing. The impeller has an approximately disk-shaped configuration with a plurality of blade grooves formed serially in a region extending along the outer peripheries of the obverse and reverse sides of the disk-shaped impeller. The outer peripheral surface of the impeller is a circumferential surface. The impeller is rotated by a driving device. The pump casing has a circumferentially extending recess for forming a circumferentially extending flow passage groove between the same and the blade grooves of the impeller. The pump casing further has a suction opening communicating with the upstream end of the recess and a discharge opening communicating with the downstream end of the recess. Further, the pump casing has a circumferential wall forming an inner peripheral surface facing the outer peripheral surface of the impeller. The clearance between the inner surface of the circumferential wall, i.e. the pump casing inner peripheral surface, and the impeller outer peripheral surface is relatively small in a region where the flow passage groove pressure is high, and the clearance is relatively large in a region where the flow passage groove pressure is low.

The impeller accommodated in the pump casing is subjected to a force derived from the flow passage groove pressure varying in the circumferential direction. An example of the force acting on the impeller will be described below with reference to FIG. 8. The impeller 90 has an approximately disk-shaped configuration with a plurality of blade grooves 91 formed serially in a region extending along the outer peripheries of the obverse and reverse sides of the disk-shaped impeller 90. The outer peripheral surface 90*a* of the impeller 90 is a circumferential surface. The impeller 90 is rotated by a driving device (not shown). The pump casing has a circumferentially extending recess 94 for forming a circumferentially extending flow passage groove between the same and the blade grooves 91 of the impeller 90. The pump casing further has a suction opening communicating with the upstream end 92 of the recess 94 (the impeller 90 rotates in the direction of the arrow R) and a discharge opening 98 communicating with the downstream end of the recess 94. Further, the pump casing has a circumferential wall 99 forming an inner peripheral surface 99*a* extending opposite the outer peripheral surface 90*a* of the impeller 90.

The pressure in the flow passage groove 94 varies as shown schematically by the arrows 96-1 to 96-10. The pressure is low in a portion adjacent to the suction opening and high in a portion adjacent to the discharge opening 98. As a result, the impeller 90 is subjected to a force, indicated by F in the figure, by the fuel pressure. Because the force F acts on the bearings supporting the impeller rotating shaft, the bearings wear out intensively in the direction of the arrow F. Consequently, the impeller 90 also shifts in the arrow F direction as the bearings wear out.

In the present invention, a relatively large clearance allowing for the expected amount of wear is ensured in a region where the flow passage groove pressure is low (i.e. a region on the side indicated by the arrow F). Therefore, even if the center of rotation of the impeller is displaced as a result of wear of the bearings, the impeller outer peripheral surface and the pump casing inner peripheral surface will not contact each other. The useful service life of the fuel pump is long as in the case of the conventional fuel pump. It should be noted that the term "relatively large clearance" as used herein means a clearance substantially equal to that in the conventional fuel pump but does not mean a clearance larger than the conventional one. In a region where the flow passage groove pressure is high (i.e. a region remote from the side indicated by the arrow F), it is unnecessary to allow for the wear. Therefore, the clearance is set smaller than the conventional clearance. Consequently, it is possible to minimize the amount of fuel leaking from the flow passage groove 94 in the region where the pressure is high, and hence possible to increase the pump efficiency.

The fuel pump according to the present invention enables the pump efficiency to be improved without reducing the useful service life of the fuel pump.

In the region where the flow passage groove pressure is high (i.e. the region remote from the side indicated by the arrow F), the clearance can be minimized without reducing the useful service life of the fuel pump. In this case, it is not always necessary to reduce the clearance in the whole region where the clearance can be reduced. The present invention may be applied intensively only to a portion where the advantages of the present invention can be offered particularly effectively.

A second structure of the fuel pump realized as stated above is as follows. A portion of the pump casing inner peripheral surface that extends from the discharge opening to the suction opening along the rotation direction of the impeller projects toward the impeller more than a portion of the pump casing inner peripheral surface that extends from the suction opening to the discharge opening along the impeller rotation direction. Consequently, the clearance between the pump casing inner peripheral surface and the impeller outer peripheral surface is relatively small in a region extending from the discharge opening to the suction opening along the rotation direction of the impeller. The clearance is relatively large in a region extending from the suction opening to the discharge opening in the impeller rotation direction.

The region extending from the discharge opening to the suction opening along the impeller rotation direction is basically where the flow passage groove pressure is high. Accordingly, even if the clearance in this region is reduced, the pump lifetime will not decrease. The region extending from the discharge opening to the suction opening along the impeller rotation direction includes a portion belonging to the region where the flow passage groove pressure is low. However, the direction of shift of the impeller position caused by the wear in this portion of the region is substantially parallel to the pump casing inner peripheral surface. Therefore, the clearance can be reduced uniformly in the region extending from the discharge opening to the suction opening along the impeller rotation direction. It is a matter of course that the clearance can be reduced only in a region extending from the discharge opening to the suction opening along the impeller rotation direction and belonging to the region where the flow passage groove pressure is high.

During use of the impeller for a long period of time, the center of rotation thereof shifts, as shown in FIGS. 9A to 9D, owing to the fact that the above-described resultant force F acts on the impeller. As shown in FIG. 9A, in a case where the center of the rotating impeller shifts from X to Y, it is preferable that the pump casing inner peripheral surface should project to extend along a line segment connecting A and B. The clearance at the projecting inner surface AB can be reduced to a minimum distance at which the impeller will not lock. The wear of the bearings need not be taken into consideration in this region.

A third structure of the fuel pump according to the present invention is as follows. Of the inner peripheral surface of the pump casing, a discharge opening-side half-circumferential surface portion (i.e. a discharge opening-side approximately half-circumferential surface portion) including the discharge opening but excluding the suction opening projects toward the impeller more than a suction opening-side half-circumferential surface portion (i.e. a suction opening-side approximately half-circumferential surface portion excluding the discharge opening) opposite the discharge opening-side half-circumferential surface portion with respect to the center line of the pump casing. The clearance is small at the discharge opening-side half-circumferential surface portion. The clearance is large at the suction opening-side half-circumferential surface portion.

As shown in FIG. 9B, in a case where the center of the impeller shifts from X to Y during use for a long period of time, the clearance can be reduced to a minimum distance at which the impeller will not lock at the discharge opening-side half-circumferential surface portion (i.e. an approximately half-circumferential surface portion indicated by hatching from C to D). The pump lifetime will not be reduced if the clearance is minimized to such an extent. Accordingly, it is possible to increase the pump efficiency while preventing the pump lifetime from being reduced.

FIG. 9C shows a maximum range within which the clearance can be reduced without the pump casing inner peripheral surface contacting the impeller while the center of the impeller is being displaced from X to Y during use for a long period of time. It will be understood from the figure that the clearance can be reduced not only at a half-circumferential region C1 where the flow passage groove pressure is high, but also at regions C2 and C3 where the impeller displacement direction is approximately parallel to the pump casing inner peripheral surface. The non-hatched region of the pump casing inner peripheral surface will hereinafter be referred to as "the expected surface portion of contact" that is expected to be contacted by the impeller outer peripheral surface when the impeller rotating shaft shifts in a predetermined direction as a result of wear of the bearings supporting the impeller rotating shaft. The pump efficiency can be further increased in a fuel pump in which a portion of the pump casing inner peripheral surface other than the expected surface portion of contact projects toward the impeller more than the expected surface portion of contact.

It is possible to set the clearance relatively small in a region where the flow passage groove pressure is high and relatively large in a region where the flow passage groove pressure is low, while maintaining basically the pump casing inner peripheral surface in the form of a circumferential surface.

In this case, the center of rotation of the impeller is offset from the center of the circumference of the pump casing inner peripheral surface.

Let us assume, as shown in FIG. 9D, that the impeller center is displaced from X to Y (distance therebetween is denoted by L) during the useful service life of the fuel pump because of the force acting on the impeller in the direction F. In this case, if the pump casing inner peripheral surface is a circumferential surface 100 centered at a position offset from X in the direction of Y by a distance L/2 (i.e. the middle point between X and Y) and having a radius equal to the sum of the impeller's radius r and L/2, there will be no interference between the impeller outer peripheral surface and the pump casing inner peripheral surface during the useful service line of the fuel pump. Reference numeral 101 denotes a circumferential surface (i.e. a circle centered at X and having a radius r+L) required in the conventional pump. Thus, the radius of the pump casing inner peripheral surface can be reduced by offsetting the center of rotation of the impeller.

In this case, the impeller rotation center may be offset with respect to the pump casing inner peripheral surface that has been finished to a circumferential surface. Alternatively, the pump casing inner peripheral surface may be finished to a circumferential surface centered at a point offset from the impeller rotation center.

The pump casing is preferably formed by combining together a pump body and a pump cover. In this case, a circumferential wall forming the pump casing inner peripheral surface may be formed on the pump body having a suction opening. Alternatively, the circumferential wall may be formed on the pump cover having a discharge opening.

In the fuel pump according to the present invention, a relatively large clearance allowing for the expected amount of wear is ensured in a region where the flow passage groove pressure is low. Therefore, even if the center of rotation of the impeller is displaced as a result of wear of the bearings, the impeller outer peripheral surface and the pump casing inner peripheral surface will not contact each other. The useful service life of the fuel pump is long as in the case of the conventional fuel pump. In a region where the flow passage groove pressure is high, it is unnecessary to allow for the wear. Therefore, the clearance is set smaller than the conventional clearance. Consequently, it is possible to minimize the amount of fuel leaking from the flow passage groove in the region where the pressure is high, and hence possible to increase the pump efficiency.

The fuel pump according to the present invention enables the pump efficiency to be improved without reducing the useful service life of the fuel pump.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DESCRIPTION OF THE PREFERRED EMBODIMENTS

A first embodiment of the present invention will be described below with reference to the accompanying drawings. The first embodiment shows a fuel pump for use in an automobile, which is used to supply fuel to the engine of the automobile.

Figure 1:
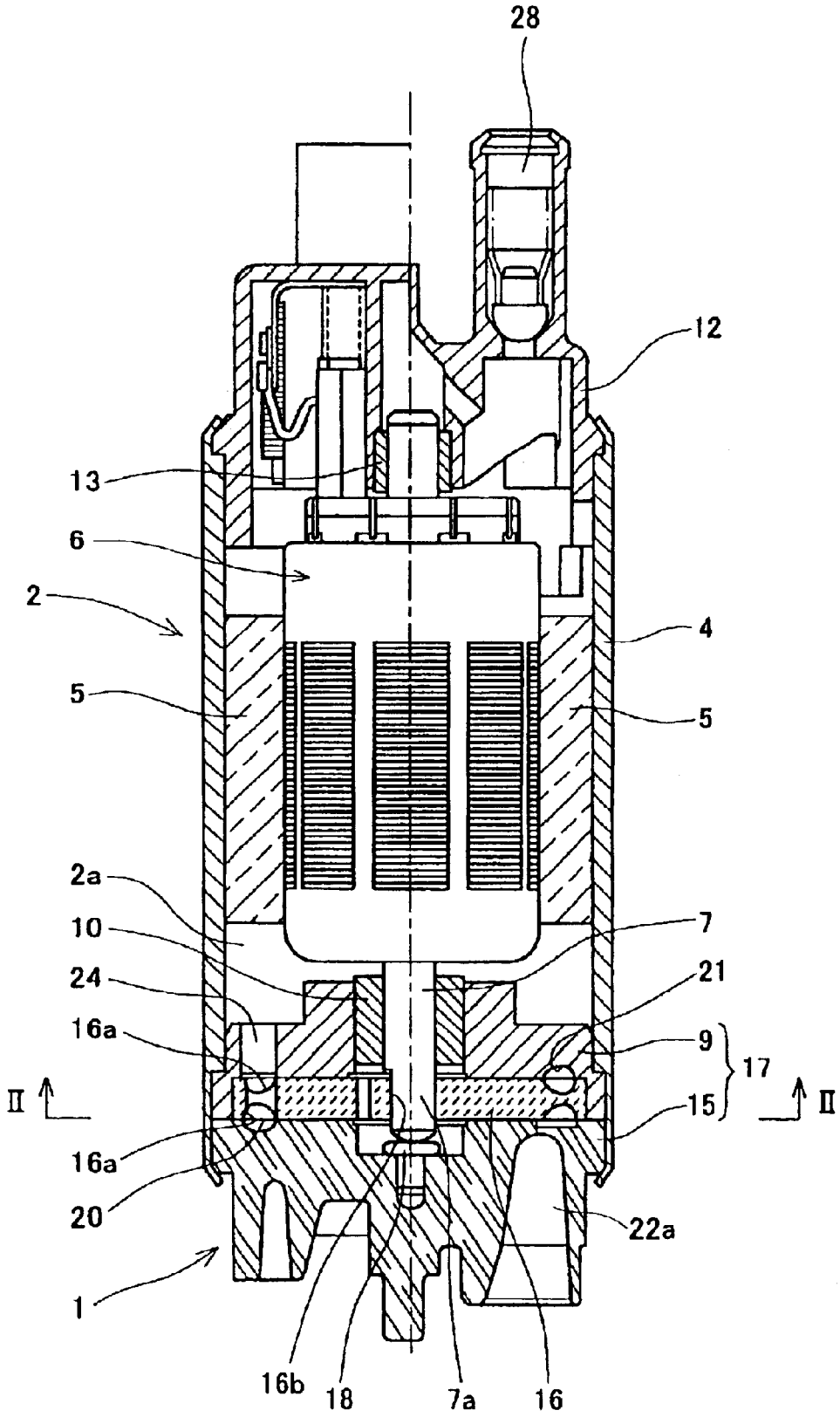
FIG. 1 is a sectional view of a fuel pump according to a first embodiment of the present invention.

FIG. 1 is a sectional view of the fuel pump. In the figure, the fuel pump has a pump part 1 and a motor part 2 for driving the pump part 1. The motor part 2 comprises a brush DC motor. The motor part 2 has an approximately circular cylinder-shaped pump housing 4. A magnet 5 is disposed in the pump housing 4. A rotor 6 is disposed in the pump housing 4 in concentric relation to the magnet 5.

The rotor 6 has a shaft 7. The lower end portion of the shaft 7 is rotatably supported through a bearing 10 by a pump cover 9 secured to the lower end portion of the pump housing 4. The upper end portion of the shaft 7 is rotatably supported through a bearing 13 by a motor cover 12 secured to the upper end portion of the pump housing 4.

In the motor part 2, the rotor 6 is rotated by supplying electric power to the coil (not shown) of the rotor 6 through a terminal (not shown) provided on the motor cover 12. It should be noted that the arrangement of the motor part 2 is well known. Therefore, a detailed description thereof is omitted. It should also be noted that the motor part 2 can use a motor structure other than the illustrated one.

The arrangement of the pump part 1 driven by the motor part 2 will be described below. The pump part 1 comprises a pump cover 9, a pump body 15, and an impeller 16. The pump cover 9 and the pump body 15 are formed by die casting of aluminum, for example. When combined together, the pump cover 9 and the pump body 15 constitute a pump casing 17 for accommodating the impeller 16.

Figure 4:
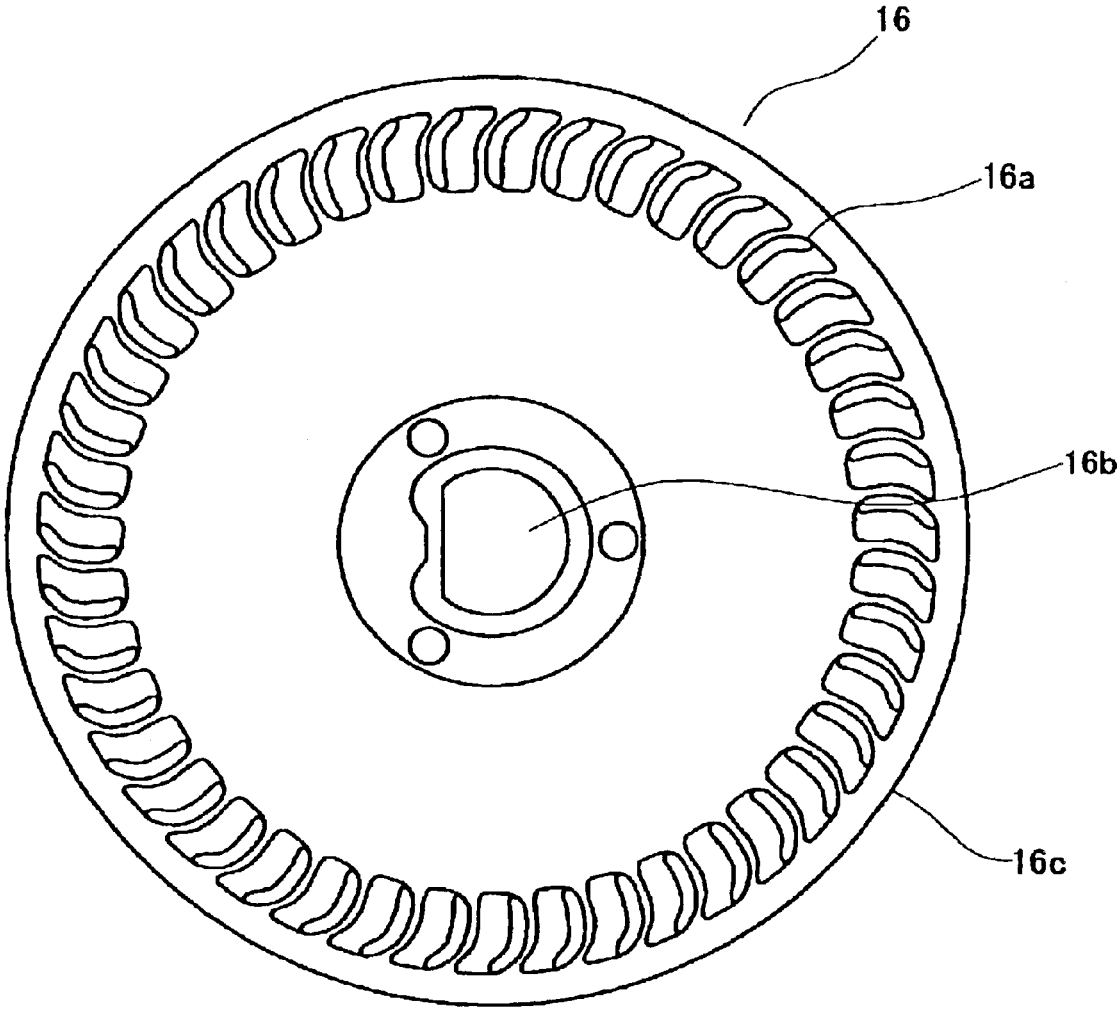
FIG. 4 is an end view of an impeller of the fuel pump according to the present invention.

The impeller 16 is formed by molding of a resin material. As shown in FIG. 4, the impeller 16 has an approximately disk-shaped configuration. A plurality of blade grooves 16*a* are formed serially in a region extending along the outer peripheries of the obverse and reverse sides of the disk-shaped impeller 16. The center of the impeller 16 is formed with an approximately D-shaped engagement hole 16*b*. The engagement hole 16*b* is engaged with an engagement shaft portion 7*a* with a D-shaped sectional configuration at the lower end of the shaft 7. Thus, the impeller 16 is connected to the shaft 7 so as to be rotatable simultaneously with the shaft 7 and slightly movable in the axial direction. The outer peripheral surface 16*c* of the impeller 16 is a circumferential surface.

Figure 2:
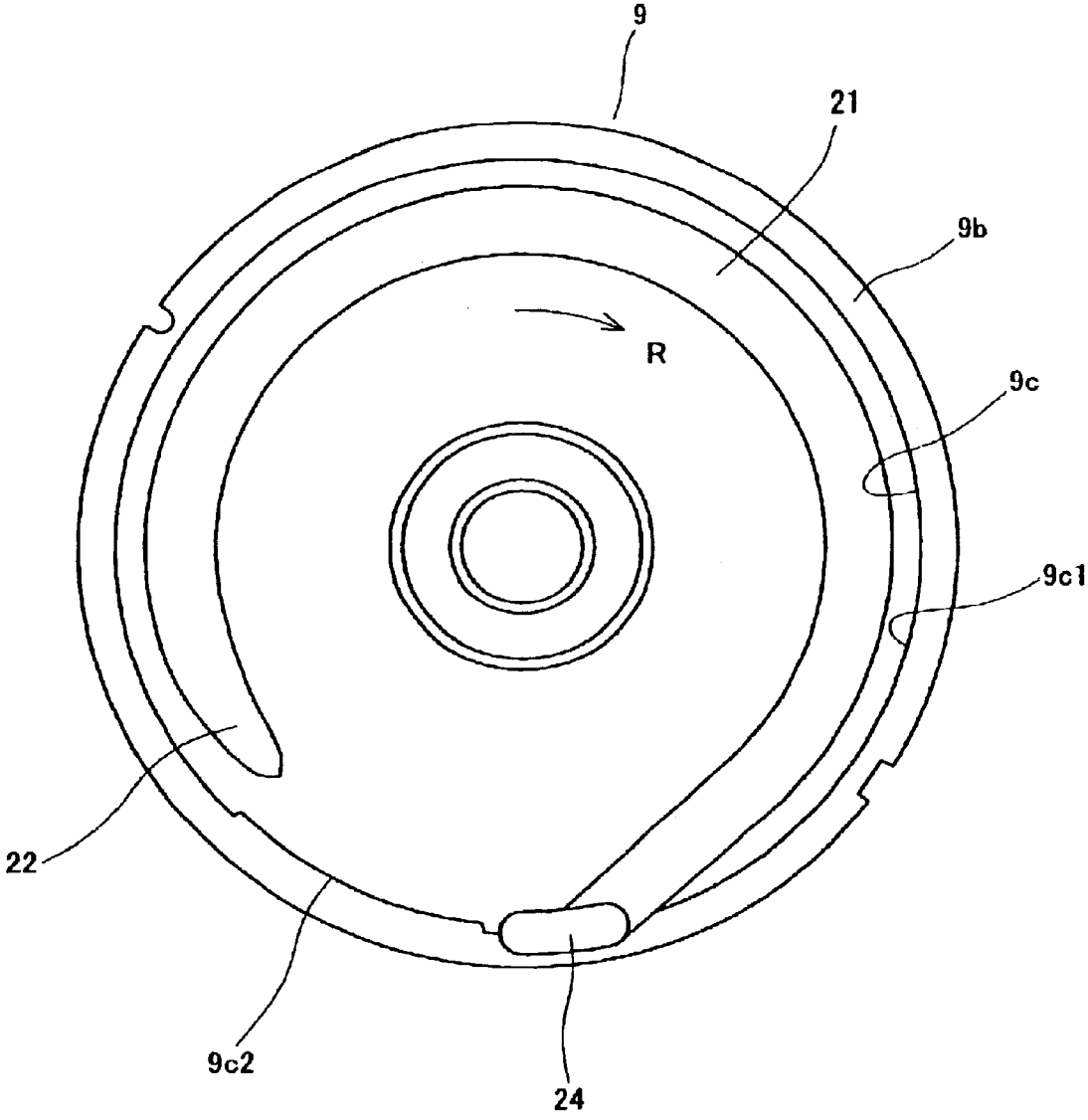
FIG. 2 is an end view of a pump cover in the first embodiment.
Figure 3:
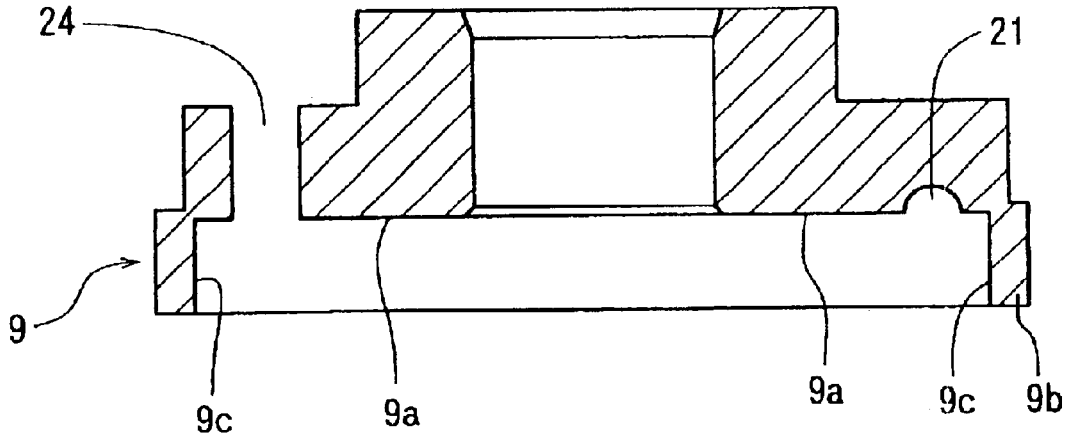
FIG. 3 is a sectional view of the pump cover.

FIG. 2 is an end view of the pump cover 9 as seen from the direction of the line II—II in FIG. 1. That is, FIG. 2 shows an end of the pump cover 9 closer to the impeller 16. FIG. 3 is a sectional view of the pump cover 9. The pump cover 9 has a circumferentially extending recess 21 for forming a circumferentially extending flow passage groove between the same and the blade grooves 16*a* of the impeller 16. The pump cover 9 further has a discharge opening 24 communicating with the downstream end of the recess 21 (the impeller 16 rotates in the direction of the arrow R). Further, the pump cover 9 has a circumferential wall 9*b*. As shown in FIG. 1, the discharge opening 24 extends through the pump cover 9 to communicate with a space 2*a* inside the motor part 2. The inner peripheral surface 9*c* of the circumferential wall 9*b* faces the outer peripheral surface 16*c* of the impeller 16 across a clearance. The inner peripheral surface 9*c* comprises a first circumferential surface portion 9*c*1 and a second circumferential surface portion 9*c*2. The first circumferential surface portion 9*c*1 extends over from the upstream end 22 of the recess 21 to the discharge opening 24 at the downstream end of the recess 21 along the rotation direction R of the impeller 16. The second circumferential surface portion 9*c*2 extends over from the discharge opening 24 to the upstream end 22 of the recess 21 along the rotation direction R of the impeller 16. The radius of the first circumferential surface portion 9*c*1 is larger than the radius of the second circumferential surface portion 9*c*2. The second circumferential surface portion 9*c*2 projects toward the impeller 16 more than the first circumferential surface portion 9*c*1.

As shown in FIG. 1, the pump body 15 is laid on the pump cover 9. In this state, the pump body 15 is secured to the lower end portion of the pump housing 4 by caulking or the like. A thrust bearing 18 is secured to the impeller-side surface of a central portion of the pump body 15. The thrust bearing 18 bears the thrust load of the shaft 7. The pump cover 9 and the pump body 15 constitute a pump casing 17. The impeller 16 is accommodated in the pump casing 17 so as to be rotatable and slightly movable in the axial direction. The inner surface of the pump body 15 is formed with a circumferentially extending recess 20 for forming a circumferentially extending flow passage groove between the same and the blade grooves 16*a* of the impeller 16. The pump body 15 further has a suction opening 22*a* communicating with the upstream end of the recess 20.

The circumferentially extending recess 21 of the pump cover 9 and the circumferentially extending recess 20 of the pump body 15 extend along the rotation direction R of the impeller 16 from a position corresponding to the suction opening 22*a* on the pump body 15 to a position corresponding to the discharge opening 24 on the pump cover 9 to form a flow passage groove extending circumferentially from the suction opening 22*a* to the discharge opening 24. When the impeller 16 rotates in the direction R, fuel is sucked into the flow passage groove from the suction opening 22*a*. While flowing through the flow passage groove from the suction opening 22*a* to the discharge opening 24, the fuel is pressurized, and the pressurized fuel is delivered to the motor part 2 from the discharge opening 24. Neither of the recesses 21 and 20 are formed in an area extending in the rotation direction R of the impeller 16 from a position corresponding to the discharge opening 24 on the pump cover 9 to a position corresponding to the suction opening 22*a* on the pump body 15, thereby preventing the pressurized fuel from returning to the suction opening 22*a* side as much as possible. It should be noted that the high-pressure fuel delivered to the motor part 2 is delivered to the outside of the pump from a delivery opening 28.

Figure 5:
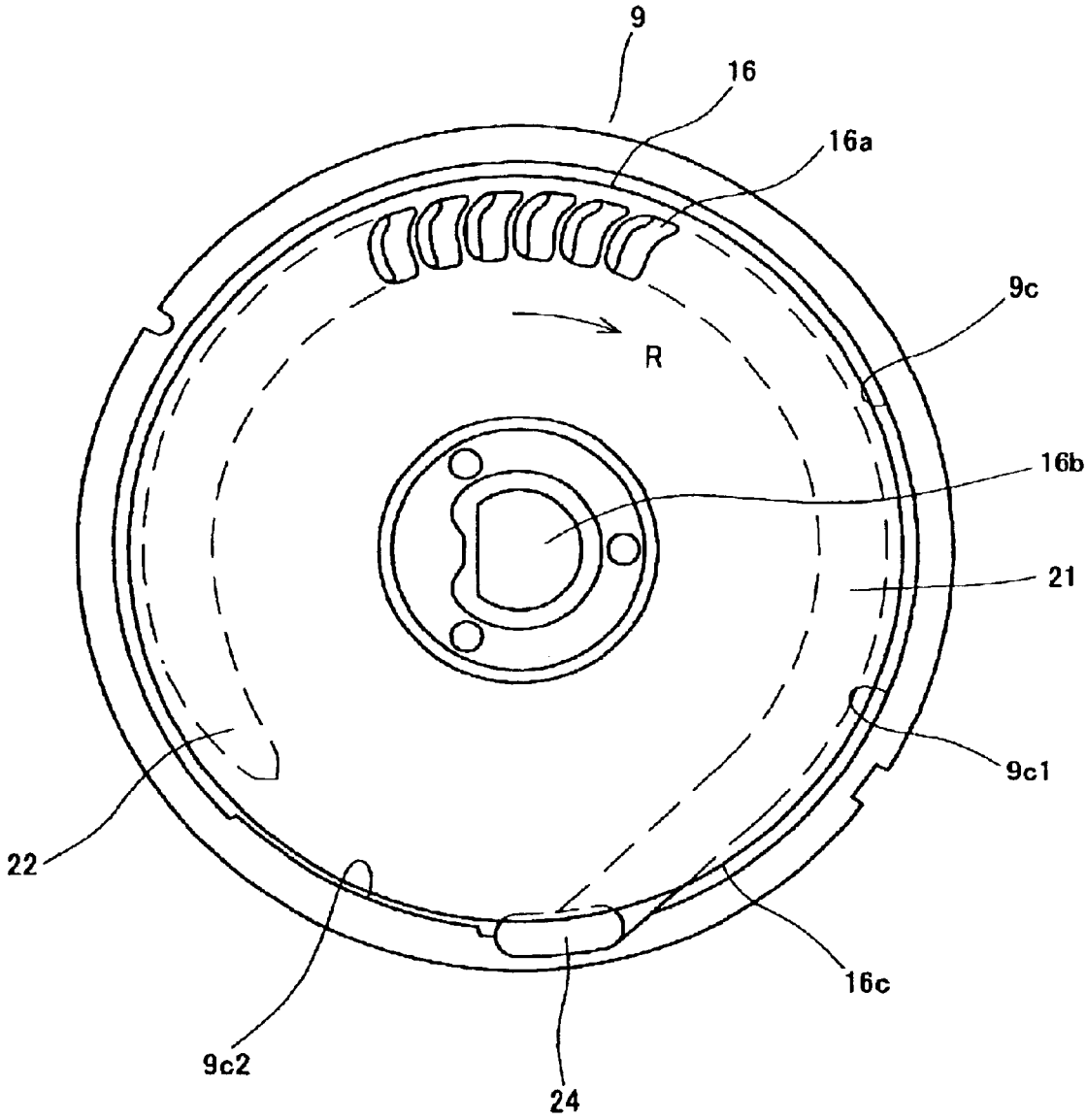
FIG. 5 is an end view showing the impeller accommodated in the pump cover according to the first embodiment.

FIG. 5 is an end view of the impeller 16 accommodated in the pump cover 9. As has been stated above, the second circumferential surface portion 9*c*2, which extends over from the discharge opening 24 to the suction opening 22*a* along the rotation direction R of the impeller 16, projects toward the impeller 16 more than the first circumferential surface portion 9*c*1, which extends over from the suction opening 22*a* to the discharge opening 24 along the rotation direction R of the impeller 16. Therefore, the clearance between the impeller outer peripheral surface 16*c* and the pump casing inner peripheral surface 9*c* is relatively large in a region extending from the suction opening 22*a* to the discharge opening 24 along the rotation direction R of the impeller 16 and relatively small in a region extending from the discharge opening 24 to the suction opening 22*a* along the rotation direction R of the impeller 16. The latter clearance is set to a minimum distance at which the impeller 16 will not lock. When the fuel pump is used for a long period of time, the center of the impeller 16 may be displaced owing to the wear of the bearings, as has been stated above. However, it has been confirmed by the studies conducted by the present inventors that the direction in which the wear of the bearings progresses is limited, and the wear of the bearings will not progress toward the circumferential wall in a region extending from the discharge opening 24 to the suction opening 22*a* along the rotation direction R of the impeller 16. Even if the clearance in this region is set at such a small distance that the impeller 16 would lock if the impeller center is displaced toward the circumferential wall in this region, there is no possibility that the outer peripheral surface 16*c* of the impeller 16 will contact the inner peripheral surface portion 9*c*2 projecting toward the impeller 16.

In this case, the clearance between the outer peripheral surface 16*c* of the impeller 16 and the inner peripheral surface 9*c* of the pump casing is reduced in the region extending from the discharge opening 24 to the suction opening 22*a* along the rotation direction R of the impeller 16. Consequently, the amount of pressurized fuel leaking out toward the suction opening 22*a* is minimized. Thus, the pump efficiency is improved.

A second embodiment of the present invention will be described below with reference to FIG. 6. The second embodiment is a modification of the first embodiment. Therefore, only the modified part of the fuel pump will be described below in detail. The other features of the second embodiment are the same as those of the first embodiment.

Figure 6:
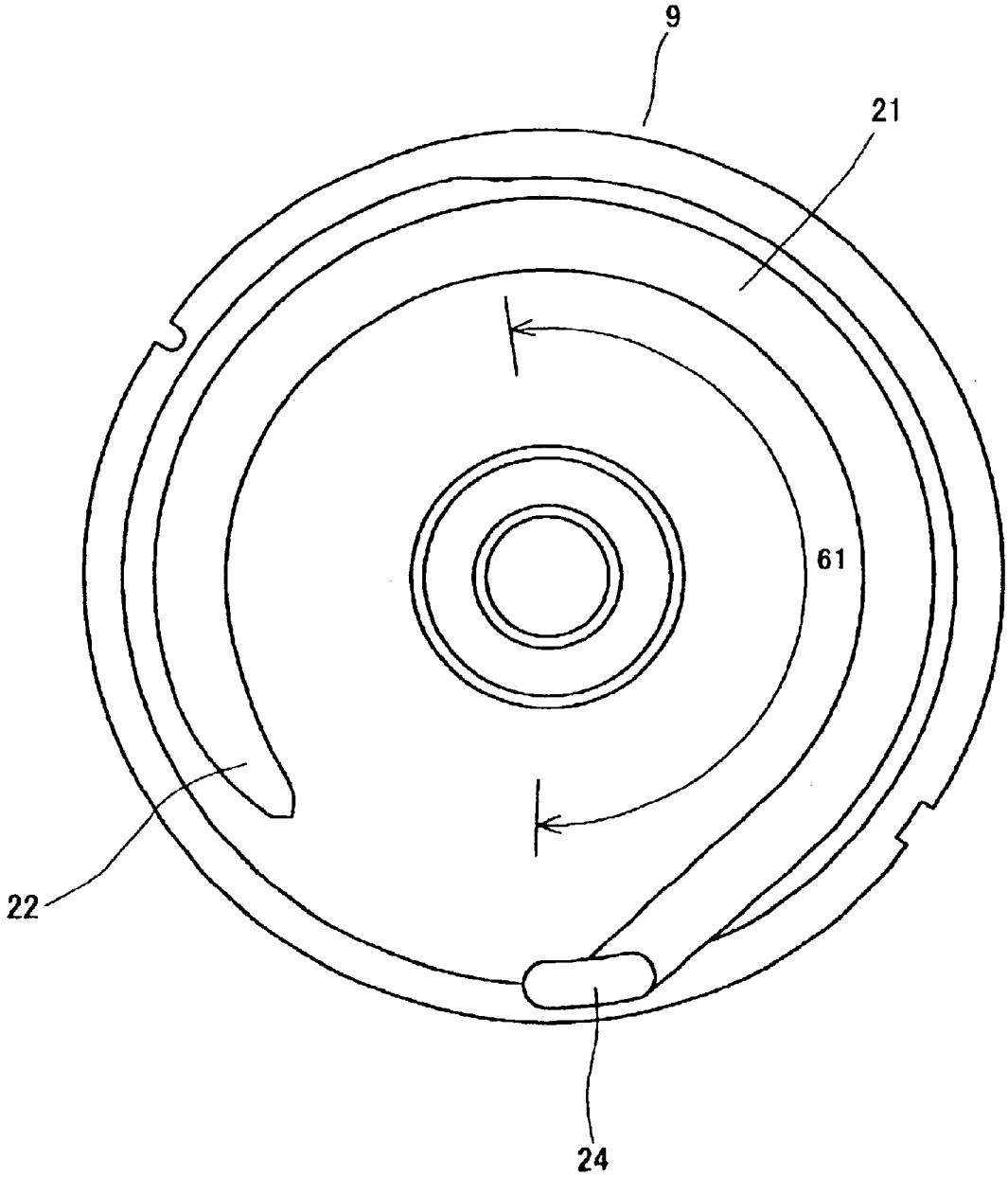
FIG. 6 is an end view of a pump cover according to a second embodiment of the present invention.

FIG. 6 is an end view showing the inner peripheral surface configuration of the pump cover 9 according to this embodiment. In the second embodiment, as shown in FIG. 6, a discharge opening-side approximately half-circumferential surface portion (indicated by the arrow 61, by way of example) of the pump casing inner peripheral surface that includes the discharge opening but excludes the suction opening projects toward the impeller 16 more than a suction opening-side approximately half-circumferential surface portion of the pump casing inner peripheral surface, which is opposite the discharge opening-side approximately half-circumferential surface portion with respect to the center line of the pump casing. In the discharge opening-side approximately half-circumferential region, the fuel pressure acting on the impeller 16 is high. Accordingly, there is no possibility of the impeller 16 being displaced toward the discharge opening-side approximately half-circumferential region. Therefore, the clearance is reduced in this region to a minimum distance at which the impeller 16 will not lock. In the approximately half-circumferential region on the opposite side, a margin is allowed for the clearance in anticipation of the possibility that the impeller 16 may be displaced toward the inner peripheral surface of the pump cover 9, thereby preventing the impeller 16 from contacting the inner peripheral surface of the pump cover 9 even if the impeller 16 is displaced during long-term use of the fuel pump.

A third embodiment of the present invention will be described below with reference to FIG. 7. The third embodiment is also a modification of the first embodiment. Therefore, only the modified part of the fuel pump will be described below in detail. The other features of the third embodiment are the same as those of the first embodiment.

Figure 7:
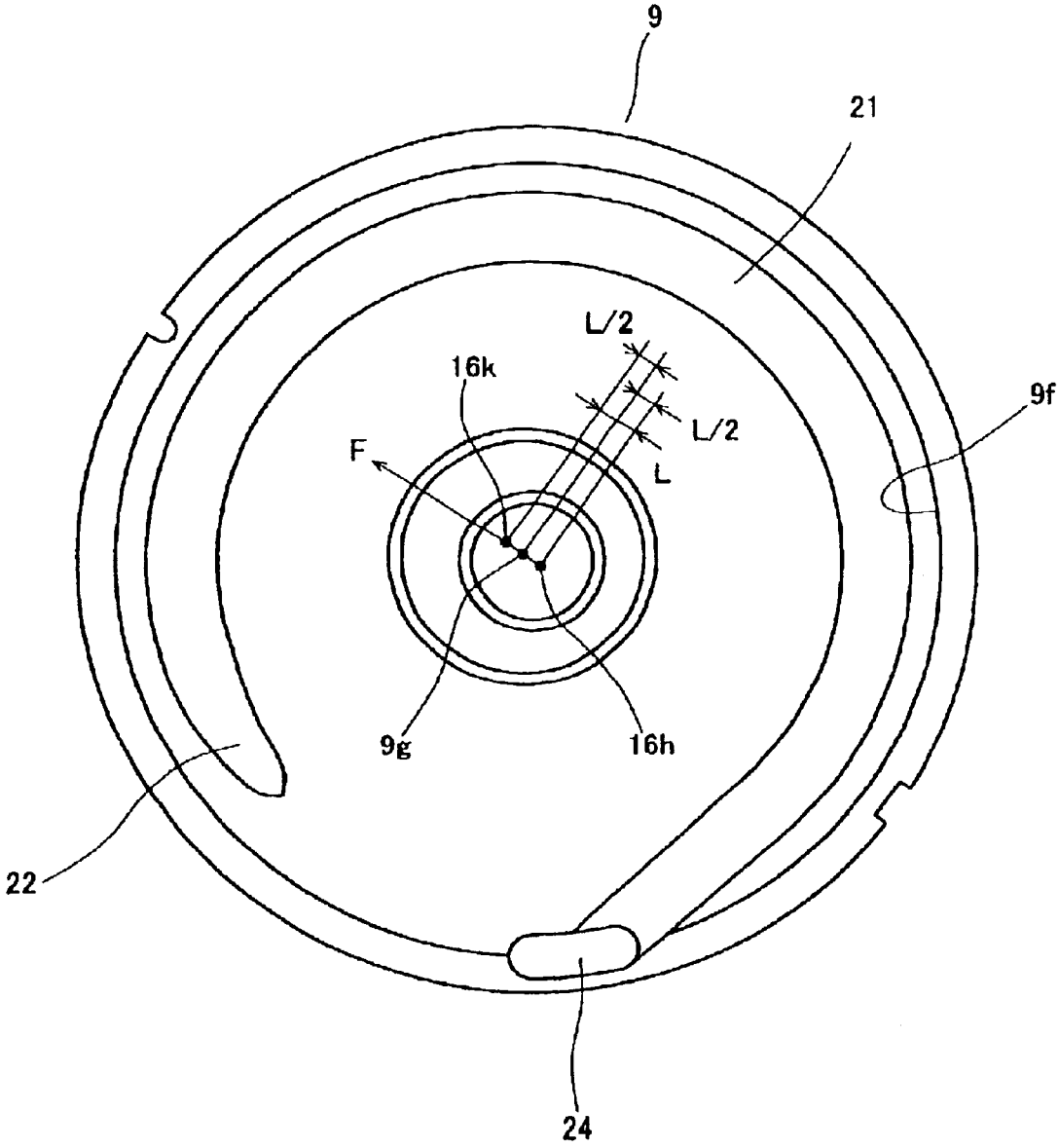
FIG. 7 is an end view of a pump cover according to a third embodiment of the present invention.
Figure 8:
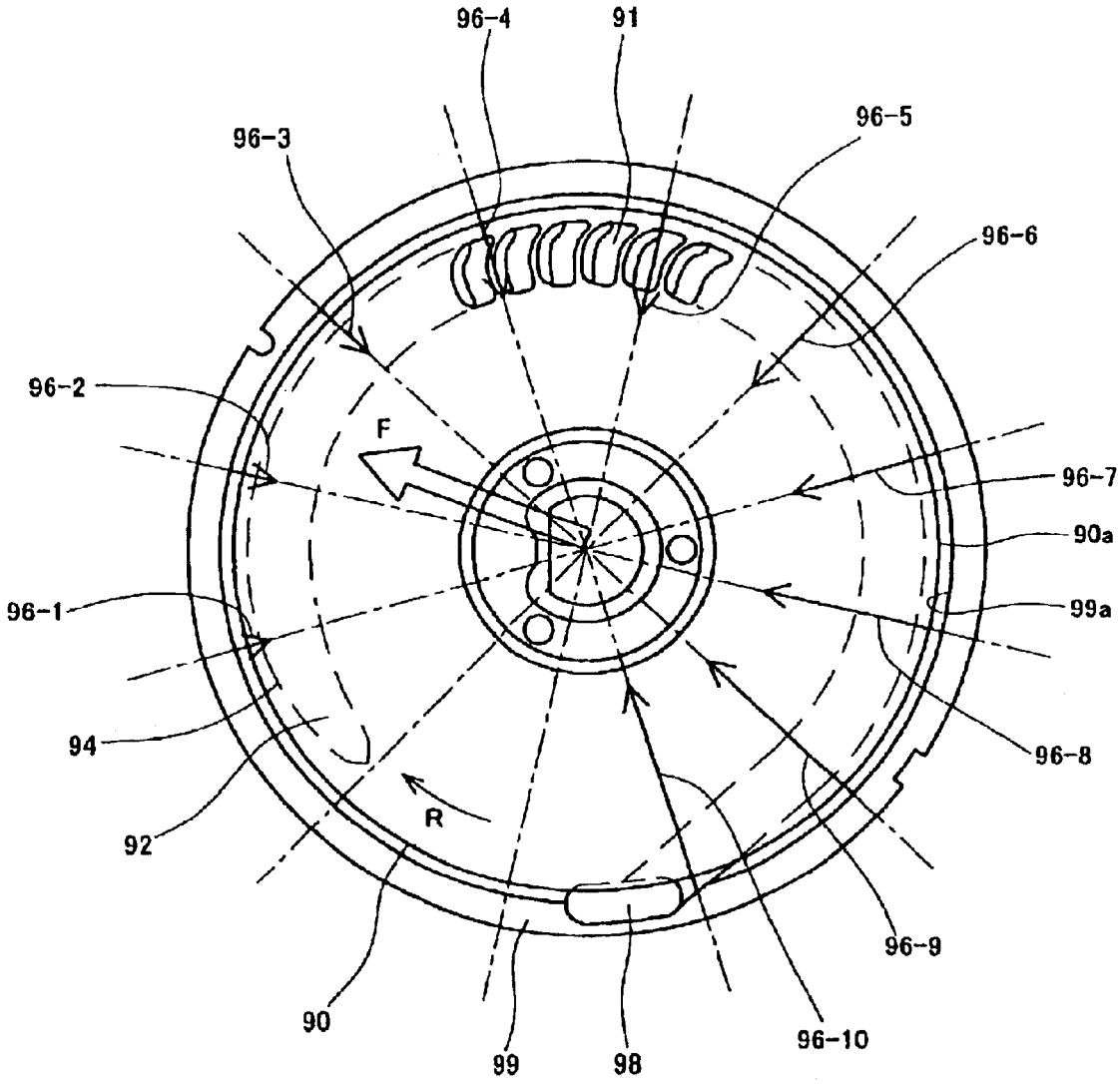
FIG. 8 is a schematic view showing the distribution of fluid pressure applied between the impeller and the peripheral inner wall of a recess in the pump cover.
Figure 9A:
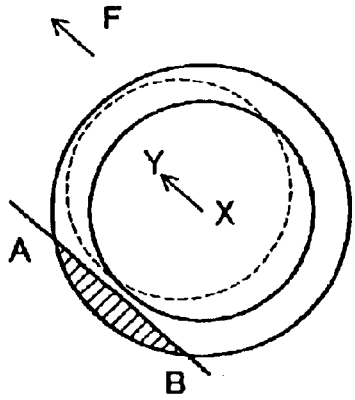
FIGS. 9A to 9D are schematic views showing the relationship between the shift of the impeller during operation and the configuration of the peripheral inner wall of the recess in the pump cover according to each embodiment.
Figure 9B:
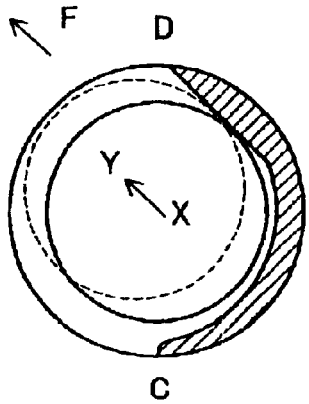
Figure 9C:
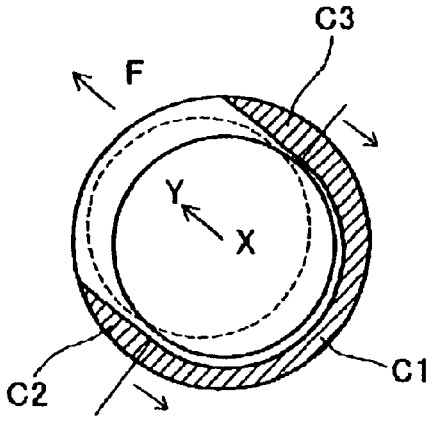
Figure 9D:
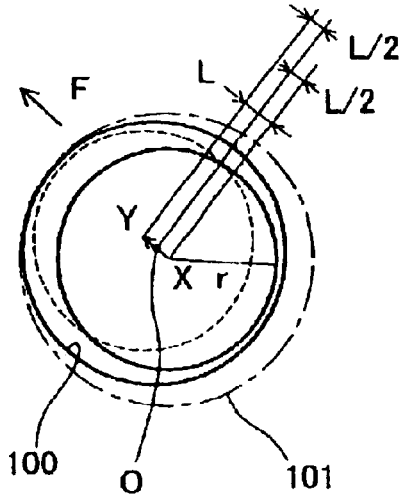

FIG. 7 is an end view showing the inner peripheral surface configuration of the pump cover 9 according to the third embodiment. In this embodiment, the inner peripheral surface 9*f* of the pump cover 9 is a circumferential surface centered at point 9*g*.

Reference symbol F in the figure denotes the direction of force acting on the impeller 16 owing to the imbalance of pressure. Reference symbol L in the figure denotes the distance through which the rotation center of the impeller 16 may be displaced as a result of wear of the bearings during the lifetime of the fuel pump guaranteed by the manufacturer.

In this case, the bearing center is provided at a position 16*h* offset in the opposite direction from the center 9*g* of the inner peripheral surface 9*f* of the pump cover 9 by L/2 at the time of manufacture.

During use for a long period of time, the bearings wear out. Consequently, the rotation center of the impeller 16 shifts from 16*h* through 9*g* to 16*k*. During this period of time, there is no possibility of the impeller outer peripheral surface contacting the inner peripheral surface 9*f* of the pump cover 9.

In this embodiment, a hole for setting bearings is formed by die casting at a position offset from the center 9*g* of the inner peripheral surface 9*f* of the pump cover 9 by L/2 in a direction opposite to the direction in which the impeller 16 may shift, i.e. toward the discharge opening 24. However, the present invention is not necessarily limited to this arrangement. Conversely, the inner peripheral surface 9*f* of the pump cover 9 may be formed by die casting so as to coincide with a circumferential surface centered at a point offset from the bearing center of the impeller 16 by L/2 in the direction in which the impeller 16 may shift. These two arrangements are equivalent to each other.

With the conventional technique, the radius of the inner peripheral surface 9*f* of the pump cover 9 needs to be set equal to the sum of the impeller radius and the distance L. The third embodiment allows the radius of the inner peripheral surface 9*f* of the pump cover 9 to be reduced by L/2 in comparison to the prior art. Accordingly, the clearance between the impeller outer peripheral surface and the pump casing inner peripheral surface can be reduced correspondingly, and the pump efficiency improves favorably.

It should be noted that advantageous effects similar to those described above can be obtained by an arrangement other than those of the embodiments exemplarily shown above. That is, the arrangement may be such that the peripheral inner wall of the recess in the pump cover 9 projects at a portion between the suction opening 22*a* communicated with the flow passage groove 21 and the discharge opening 24 where no flow passage groove is provided, and also projects at an approximately half-circumferential portion on a side of the pump cover 9 closer to the discharge opening 24 communicated with the flow passage groove 21. In other words, the inner peripheral surface of the pump cover 9 may be shaped so as to have the features of both the first and second embodiments.

It should be noted that the present invention is not necessarily limited to the above-described embodiments, and that various changes and modifications may be imparted thereto without departing from the gist of the present invention. For example, the present invention is not necessarily limited to automotive fuel pumps but may be widely used as pumps for delivering various fluids such as water under pressure. Further, the technical elements described in this specification or in the drawings exhibit technical utility singly or in various combinations and are not limited to the combinations recited in the claims as filed. The techniques illustrated in this specification or in the drawings attain a plurality of purposes simultaneously, and attaining one of the purposes per se offers technical utility.

What is claimed is:

1. A fuel pump comprising:

an impeller having an approximately disk-shaped configuration with a plurality of blade grooves formed serially in a region extending along outer peripheries of obverse and reverse sides of the impeller, wherein an outer peripheral surface of said impeller is a circumferential surface, said impeller being rotated by driving means; and a pump casing having a circumferentially extending recess for forming a circumferentially extending flow passage groove between the same and the blade grooves of said impeller, said pump casing further having a suction opening communicating with an upstream end of said recess and a discharge opening communicating with a downstream end of said recess, said pump casing further having a circumferential wall forming an inner peripheral surface facing the outer peripheral surface of said impeller;

wherein a clearance between the outer peripheral surface of said impeller and the inner peripheral surface of said pump casing is relatively small in a region where a flow passage groove pressure is high, said clearance is relatively large in a region where the flow passage groove pressure is low, and a rotation center of said impeller is offset from a center of the inner peripheral surface of said pump casing.

2. A fuel pump according to claim 1, wherein said pump comprising a combination if a pump body having said suction opening and a pump cover having said discharge opening and said circumferential wall.

3. A fuel pump comprising:

an impeller having an approximately disk-shaped configuration with a plurality of blade grooves formed serially in a region extending along outer peripheries of obverse and reverse sides of the impeller, wherein an outer peripheral surface of said impeller is a circumferential surface, said impeller being rotated by driving means; and a pump casing having a circumferentially extending recess for forming a circumferentially extending flow passage groove between the same and the blade grooves of said impeller, said pump casing further having a suction opening communicating with an upstream end of said recess and a discharge opening communicating with a downstream end of said recess, said pump casing further having a circumferential wall forming an inner peripheral surface facing the outer peripheral surface of said impeller;

wherein a clearance between the outer peripheral surface of said impeller and the inner peripheral surface of said pump casing is relatively small in a region where a flow passage groove pressure is high, said clearance is relatively large in a region where the flow passage grove pressure is low, and the inner peripheral surface of said pump casing has an expected surface portion of contact that is expected to be contacted by the outer peripheral surface of said impeller when an impeller rotating shaft shifts in a predetermined direction as a result of war of bearings supporting the impeller rotating shaft, and wherein a portion of the inner peripheral surface of said pump casing other than said expected surface portion of contact projects toward said impeller more than said expected surface portion of contact.

* * * * *